US006558531B2

(12) United States Patent
Steffens et al.

(10) Patent No.: US 6,558,531 B2
(45) Date of Patent: May 6, 2003

(54) METHOD FOR MAINTAINING HEAT BALANCE IN A FLUIDIZED BED CATALYTIC CRACKING UNIT

(75) Inventors: Todd R. Steffens, Centreville, VA (US); Paul K. Ladwig, Centreville, VA (US); George Melfi, Whippany, NJ (US); John E. Asplin, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 0 days.

(21) Appl. No.: 09/804,721

(22) Filed: Mar. 13, 2001

(65) Prior Publication Data

US 2001/0025806 A1 Oct. 4, 2001

Related U.S. Application Data

(60) Provisional application No. 60/194,444, filed on Apr. 4, 2000.

(51) Int. Cl.[7] ..... C10G 11/00

(52) U.S. Cl. ..... 208/113; 208/159; 502/45; 502/46; 502/49

(58) Field of Search ..... 208/113, 159; 502/45, 46, 49

(56) References Cited

U.S. PATENT DOCUMENTS

| | | | | | |
|---|---|---|---|---|---|
| 2,929,774 | A | | 3/1960 | Smith | 208/113 |
| 3,351,548 | A | * | 11/1967 | Payne et al. | 208/120.01 |
| 3,893,812 | A | * | 7/1975 | Conner et al. | 208/164 |
| 3,966,587 | A | | 6/1976 | Bittensky et al. | 208/164 |
| 4,035,284 | A | * | 7/1977 | Gross et al. | 208/113 |
| 4,093,537 | A | * | 6/1978 | Gross et al. | 208/164 |
| 4,272,402 | A | | 6/1981 | Mayes | 252/417 |
| 4,283,273 | A | | 8/1981 | Owen | 208/113 |
| 5,547,910 | A | * | 8/1996 | Demmel et al. | 208/113 |

FOREIGN PATENT DOCUMENTS

| | | |
|---|---|---|
| FR | 2 255 948 | 7/1975 |

* cited by examiner

*Primary Examiner*—Walter D. Griffin
(74) *Attorney, Agent, or Firm*—Lucinda Lomas; James A. Zboray

(57) ABSTRACT

The invention relates to a process for maintaining heat balance in a fluidized bed catalytic cracking unit. More specifically, the invention relates to a combustion control method capable of maintaining or restoring heat balance by conducting, under appropriate conditions, fuel and an oxygen-containing gas to a transfer line. The transfer line conducts effluent including spent catalyst and combustion products to the unit's catalyst regeneration zone.

27 Claims, 4 Drawing Sheets

METHOD FOR MAINTAINING HEAT BALANCE IN A FLUIDIZED BED CATALYTIC CRACKING UNIT

CROSS-REFERENCE TO RELATED APPLICATION

This patent application claims benefit of U.S. provisional patent application Ser. No. 60/194,444 filed Apr. 4, 2000.

FIELD OF THE INVENTION

The invention relates to a process for maintaining heat balance in a continuous fluidized bed catalytic cracking unit. More specifically, the invention relates to a combustion control method capable of maintaining or restoring heat balance by conducting, under appropriate conditions, fuel and an oxygen-containing gas to a transfer line. The transfer line conducts effluent including catalyst and combustion products to a zone where the catalyst is separated from the effluent and returned to the process.

BACKGROUND OF THE INVENTION

In a continuous fluid solids based catalytic cracking unit such as a fluidized catalytic cracking ("FCC") unit, flowing hot regenerated catalyst is conducted to the base of a feed riser. A feed such as naphtha, gas oil, resid, heavy oil, and mixtures thereof is injected into the feed riser at a point downstream of the riser's base. Typically, the downstream end of the feed riser terminates in a reactor vessel. Cracked product is taken overhead from the reactor vessel, and spent catalyst containing adsorbed hydrocarbons such as coke passes through a stripping region in the reactor vessel and then through a transfer line to a regenerator vessel. Coke is burned off the spent catalyst in the regenerator's oxygen rich environment in order to heat and re-activate the catalyst. When the heat supplied by the combustion of the coke in the regenerator is equal to the heat dissipated by reaction endotherm, sensible heat to process streams, latent heat of vaporization where liquid process streams are introduced, and heat losses, the unit is said to be in heat balance.

While coke is necessary in conventional FCC processes for catalyst heating during regeneration, the amount of coke formed on the catalyst may be limited by, for example, operational parameters and feed choice. Operationally, it may be desirable to limit the amount of coke produced in order to increase the amount of carbon available in the process for forming more valuable (generally lower molecular weight) products. Moreover, coke formed in the reaction process may contain undesirable sulfur and nitrogen species, leading to increased environmental regulation compliance costs.

Additionally, some FCC processes use feeds which lead to less coke formation on the catalyst. For example, where the unit's feed contains naphtha or a higher boiling feed which has been severely hydrotreated, substantially less coke is formed on the catalyst resulting in less heat produced by burning the coke in the regenerator. Such feeds, therefore detrimentally affect the unit's heat balance.

Added heat is required when factors such as operating conditions or feed choice result in insufficient coke combustion to maintain the unit in heat balance. Moreover, non-steady-state operations, particularly such as occur during start-up, require additional heat to restore or maintain heat balance, even in cases where sufficient coke is normally present during operation.

One conventional FCC method for providing additional heat to the catalyst involves injecting a fuel such as torch oil into the oxygen-rich environment inside the regenerator. Torch oil, which may be FCC feed or derived therefrom, bums in the regenerator under combustion conditions that are at least stoichiometric (or leaner). Unfortunately torch oil burning results in high localized regenerator temperatures, and may lead to, for example, mechanical damage to the FCC unit, catalyst deactivation, catalyst decomposition, and combinations thereof.

In another conventional process, heat is provided by contacting and mixing the spent catalyst with a liquid fuel before the spent catalyst enters the regenerator. The liquid fuel then bums on the catalyst in the regenerator. Unfortunately, excessive catalyst temperatures may result during regeneration, especially in the most oxygen-rich regions of the regenerator. Moreover, while it is sometimes desirable to produce a significant amount of CO during regeneration, such processes typically result in complete combustion of the fuel to $CO_2$.

In yet another conventional process, spent catalyst, freshly regenerated catalyst, fuel, and air are conducted to a mixing zone leading to the regenerator in order to control catalyst circulation. While the process results in adding heat to the FCC unit, catalyst temperatures as high as 1600° F. are encountered.

There is therefore a need for improved methods for maintaining or restoring heat balance in a fluidized bed catalytic cracking unit that do not result in excessive catalyst temperatures and that regulate the amount of CO in the regenerator.

SUMMARY OF THE INVENTION

In one embodiment, the invention is a fluidized bed catalytic cracking process comprising the continuous steps of:

(a) conducting a hydrocarbon-containing feedstream to a reaction zone where the feed contacts a source of hot, regenerated catalyst in order to form at least cracked products and spent catalyst;

(b) conducting the cracked products and the spent catalyst to a separation zone and separating the spent catalyst;

(c) conducting the spent catalyst to a transfer line;

(d) conducting a fuel and an oxygen-containing gas independently to one or more points along the transfer line and combusting the fuel and the oxygen in the transfer line in order to form an effluent containing the hot, regenerated catalyst;

(e) separating the hot, regenerated catalyst from the transfer line's effluent and then;

(f) conducting the hot, regenerated catalyst to step (a).

Preferably, the spent catalyst has a temperature ranging from about 900 to about 1175° F., more preferably from about 900 to about 1150° F., and still more preferably from about 900 to about 1100° F. Preferably, the hot, regenerated catalyst has a temperature ranging from about 1200 to about 1400° F., more preferably from about 1200° F. to about 1300° F., and still more preferably from about 1250° F. to about 1285° F.

In one preferred embodiment, the transfer line is a zoned transfer line including at least a first zone, a third zone downstream of the first zone, and a second zone situated therebetween. Preferably, at least a portion of the oxygen-containing gas and the fuel are combusted in the first zone to form CO, and at least a portion of the CO in the second zone and the zone(s) downstream of the second zone is oxidized in order to form $CO_2$. More preferably, at least a portion of the oxygen-containing gas and fuel are combusted under sub-stoichiometric conditions in the zones downstream of the first zone in order to form CO, and at least a portion of the CO in the zones downstream of the second zone is oxidized in order to form $CO_2$.

In another preferred embodiment, the fuel is conducted to the first zone, and the oxygen-containing gas is conducted to at least the second and third zones. At least a portion of the oxygen-containing gas and the fuel are combusted under partial oxidation conditions in the zones downstream of the first zone in order to form CO, and at least a portion of the CO in the zone(s) downstream of the second zone is oxidized in order to form $CO_2$.

In yet another preferred embodiment, the oxygen-containing gas is conducted to the first zone, and the fuel is conducted to the zones downstream of the first zone. The amount and distribution of the fuel is regulated to provide distributed combustion along the transfer line resulting in localized temperatures in the transfer line below the catalyst deactivation temperature.

DETAILED DESCRIPTION

The invention is based on the discovery that heat balance may be restored in a coke-limited FCC unit by independently conducting a fuel and an oxygen-containing gas to the transfer line at one or more points between the reactor and the regenerator. When the amount and temperature of the fuel, the air, and the catalyst are regulated to produce autoignition of the fuel in the bulk phase of the transfer line, distributed burning of the fuel will occur in the transfer line so that heat is supplied to the catalyst. Unit heat balance may consequently be restored. Elimination of a defined region of excessive temperature caused by a localized combustion zone results in substantially lessened catalyst deactivation.

In addition to maintaining or restoring heat balance, the invention also provides increased operating control and flexibility of parameters such as temperature and flue gas composition in the transfer line in order to optimize catalyst regeneration as well as contaminant metals oxidation state and effects. Moreover, the invention may be applied to a conventional FCC unit as a replacement for torch oil firing, to ameliorate the economic debit associated with high catalyst replacement rates, low yields, and undesirable product selectivities resulting from the deactivation of the catalyst. Additionally, the invention allows flexibility in fuel composition such that either gas or liquid fuels with reduced environmental impact, such as lower sulfur fuels, can be used to reduce potential flue gas emissions from the unit without deactivating the catalyst.

Figure 1:
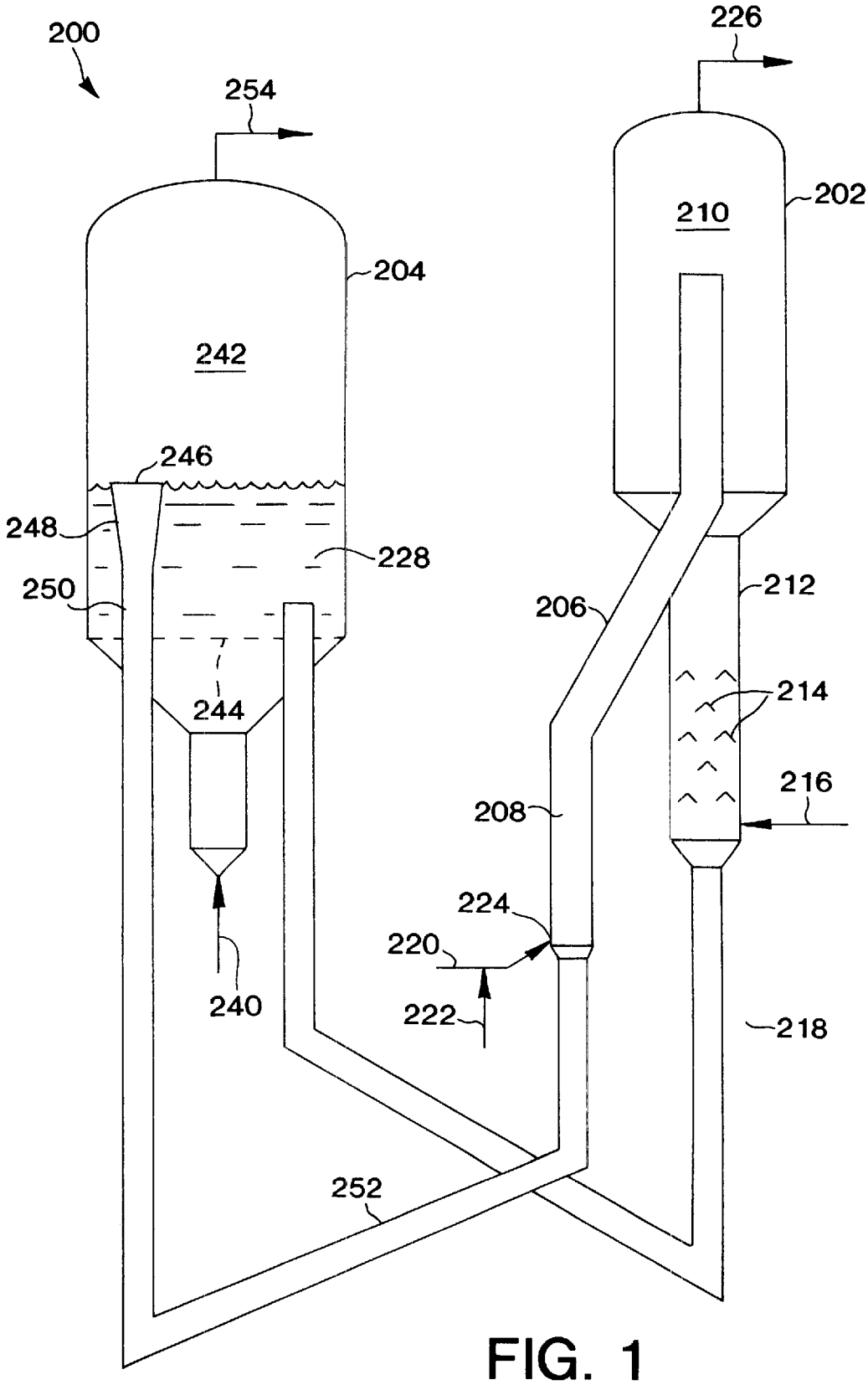
FIG. 1 is a simplified schematic of a fluid cat cracking process useful in the process of the invention.

FIG. 1 is a simplified schematic of a fluid cat cracking process useful in the description of the invention. Thus, an FCC unit 200 is shown comprising a catalytic cracking reactor unit 202 and a regeneration unit 204. Unit 202 includes a feed riser 206, the interior of which comprises the reaction zone, the beginning of which is indicated as 208. It also includes a vapor-catalyst disengaging zone 210 and a stripping zone 212 containing a plurality of baffles 214 within, in the form of arrays of metal "sheds" which resemble the pitched roofs of houses. A suitable stripping agent such as steam is introduced into the stripping zone via line 216. Transfer line 218 conducts the stripped, spent catalyst particles to regenerating unit 204. In one embodiment of the invention, air and fuel are injected into the transfer line at one or more points between the stripping zone and the regenerator.

A preheated FCC feed is passed via line 220 into the base of riser 206 at feed injection point 224 of the fluidized cat cracking reactor unit 202. Steam may be injected into the feed injection unit via line 222. As set forth below, the feed contains hydrocarbon such as naphtha, vacuum gas oil (VGO), heavy oil, resid fractions, and mixtures thereof. The atomized droplets of the hot feed are contacted with particles of hot, regenerated cracking catalyst in the riser. This vaporizes and catalytically cracks the feed into lighter, lower boiling fractions, including fractions in the gasoline boiling range (typically 100–400° F.), as well as higher boiling diesel fuel and the like. Conventional FCC catalyst such as a mixture of silica and alumina containing a zeolite molecular sieve cracking component may be employed. Such catalysts exhibit some deactivation at temperatures of about 1300° F. and higher, and are considered to be undesirably deactivated at temperatures above 1400° F. The catalytic cracking reactions start when the feed contacts the hot catalyst in the riser at feed injection point 234 and continues until the product vapors are separated from the spent catalyst in the upper or disengaging section 210 of the cat cracker. The cracking reaction deposits non-strippable carbonaceous material, together with strippable hydrocarbonaceous material adsorbed on the catalyst, known collectively as coke. Such coke-containing catalyst is commonly referred to as spent catalyst. Spent catalyst may be stripped to remove and recover strippable hydrocarbonaceous material and then regenerated by burning off the remaining coke in the regenerator. As discussed, some feed choices, operating conditions, and combinations thereof may result in insufficient coke formation to provide or maintain unit heat balance. In a preferred embodiment, heat balance is restored or maintained by the distributed burning of a fuel under appropriate conditions in the transfer line.

Accordingly, As shown in FIG. 1, reaction unit 202 may contain cyclones (not shown) in the disengaging section 210, which separate both the cracked hydrocarbon product vapors and the stripped hydrocarbons (as vapors) from the spent catalyst particles. The hydrocarbon vapors pass up through the reactor and are withdrawn via line 226. The hydrocarbon vapors may be conducted to a distillation unit (not shown) which condenses the condensable portion of the vapors into liquids and fractionates the liquids into separate product streams. The spent catalyst particles fall down into stripping zone 212 where they contact a stripping medium, such as steam, which is fed into the stripping zone via line 216 and removes, as vapors, the strippable hydrocarbonaceous material deposited on the catalyst during the cracking reactions. These vapors are withdrawn along with the other product vapors via line 226. The baffles 214 disperse the catalyst particles uniformly across the width of the stripping zone or stripper and minimize internal refluxing or backmixing of catalyst particles in the stripping zone.

The spent, stripped catalyst particles are removed from the bottom of the stripping zone via transfer line 218, and conducted via the transfer line into fluidized bed 228 in vessel 204 where they may be contacted with air or other fluidizing medium as required, entering the vessel via line 240. In embodiments where incomplete catalyst regeneration occurs in the transfer line, the vessel 204 may function as a regenerator in order to fully regenerate the catalyst before it is returned to the reaction zone. In such cases, the catalyst is regenerated under FCC regeneration conditions in vessel 204. In cases where the catalyst is fully regenerated in the transfer line, vessel 204 serves to separate hot, regenerated catalyst for return to the reaction zone.

As discussed, the stripped catalyst is heated and at least partially regenerated in the region of the transfer line 218 from its low point between the reactor unit to the point where the transfer line enters the vessel 204. Fuel and an oxygen-containing gas are conducted to the transfer line, and the amounts and injection locations of each are regulated to provide for distributed burning of the fuel in the transfer line in order to heat and at least partially regenerate the catalyst.

An effluent containing fluidized catalyst and combustion products flows through the downstream end of the transfer line into a separation zone exemplified in FIG. 1 by vessel 204, where regenerated and heated catalyst may be separated from the effluent and returned to the reaction zone. When the catalyst in the transfer lines effluent is not fully regenerated, i.e. when it bears more than the desired amount of coke for the catalyst used in the reaction zone, the separation zone (vessel 204) may function as a conventional FCC regenerator in order to complete the regeneration of the catalyst. Accordingly, when air is used as the fluidizing medium in the regenerator, any coke remaining on the catalyst may be oxidized or burned off in order to regenerate the catalyst particles and in so doing, complete the heating of the particles up to a temperature which typically ranges from about 950–1400° F. Vessel 204 may contain cyclones (not shown) or some other means for which separating hot regenerated catalyst particles from the gaseous combustion products (flue gas), which comprises mostly $CO_2$, CO, $H_2O$ and $N_2$ and feed the regenerated catalyst particles back down into fluidized catalyst bed 228, by means of diplegs (not shown), as is known to those skilled in the art. The fluidized bed 228 may be supported on a gas distributor grid, which is schematically illustrated as dashed is line 244. The hot, regenerated catalyst particles in the fluidized bed overflow the weir 246 formed by the top of a funnel 248, which is connected at its bottom to the top of a downcomer 250. The bottom of downcomer 250 turns into a regenerated catalyst transfer line 252. The overflowing, regenerated particles flow down through the funnel, downcomer and into the transfer line 252 which passes them back into the riser reaction zone, in which they contact the hot feed entering the riser from the feed injector. The flue gas is removed from the top of the regenerator via line 254.

Preferably, the spent catalyst has a temperature ranging from about 900 to about 1175° F., more preferably from about 900 to about 1150° F., and still more preferably from about 900 to about 1100° F. Preferably, the hot, regenerated catalyst has a temperature ranging from about 1200 to about 1400° F., more preferably from about 1200° F. to about 1300° F., and still more preferably from about 1250° F. to about 1285° F.

Preferably, the amount of oxygen-containing gas is regulated in zones containing a significant amount of uncombusted fuel to provide sub-stoichiometric combustion conditions. The amount of oxygen-containing gas in zones containing a significant amount of CO is regulated to provide conditions including sub-stoichiometric, stoichiometric, and super-stoichiometric combustion conditions, depending on the amount of un-combusted fuel in the zone. Generally, sub-stoichiometric conditions are preferred when the zone contains a substantial amount of un-combusted fuel, and super stoichiometric conditions are preferred when the zone contains little or no un-combusted fuel. In other words, the greater the amount of un-combusted fuel in the zone, the more sub-stoichiometric conditions are preferred. Sub-stoichiometric combustion conditions are sometimes called "partial oxidation" conditions because the combustion products contain an enhanced amount of CO and a diminished amount of $CO_2$.

Figure 2:
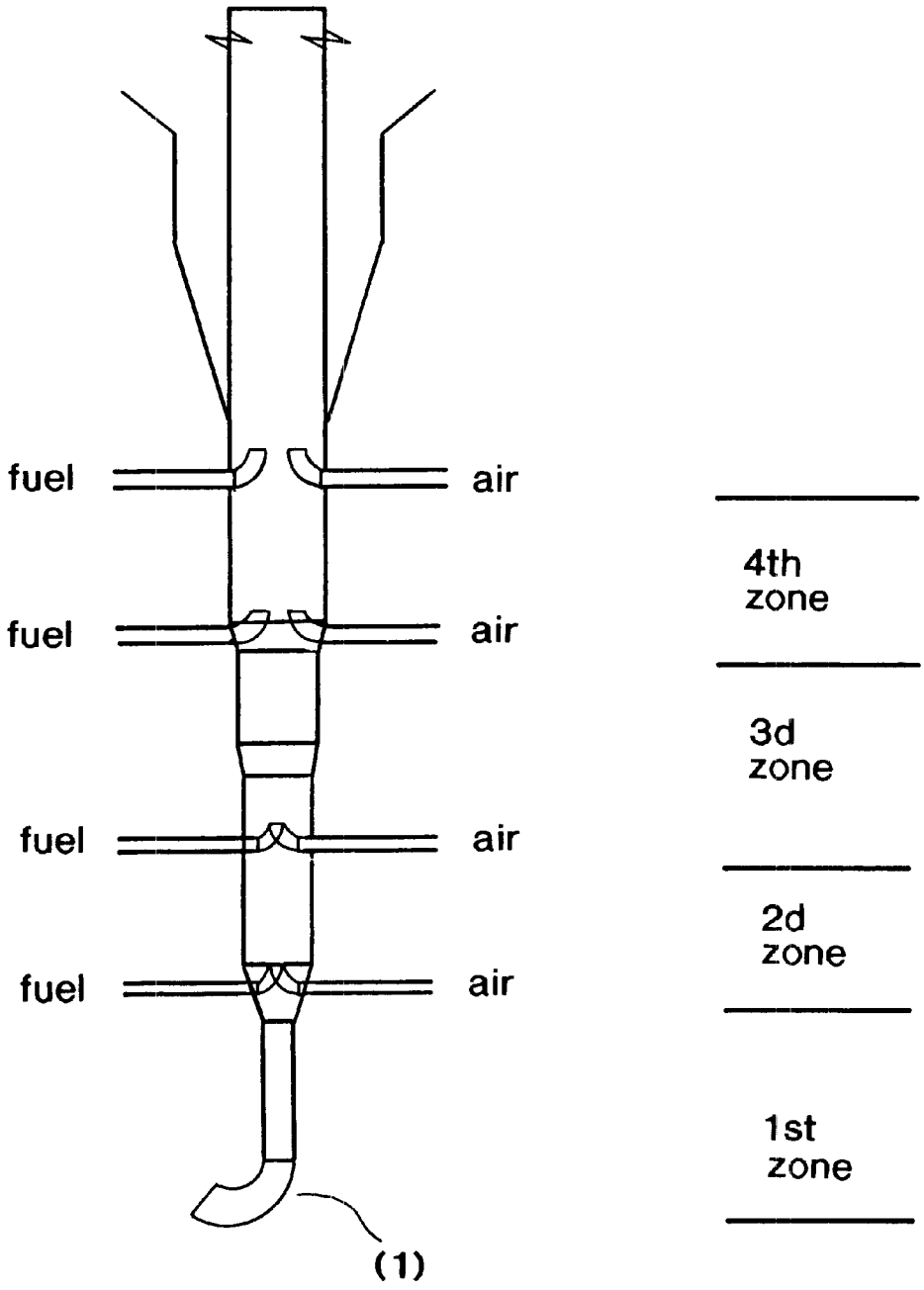
FIG. 2 schematically shows a preferred air riser swedged to provide a desired velocity profile as air and fuel are added along the riser.

FIG. 2 illustrates preferred embodiments for the transfer line in the region from its low point between the reactor unit to the point where the transfer line enters separation zone 204. As shown, fuel and air are injected at one or more points along the transfer line, in order to provide distributed combustion of the fuel along the transfer line.

In a first embodiment, the total amount of fuel required to maintain or restore heat balance is injected at a point near the base of the riser through a fuel line and one or more injectors located at point (1). No additional fuel is injected in the downstream region of the transfer line. A heated oxygen-containing gas is injected into the transfer line at one or more points between the fuel injection point and the downstream end of the transfer line. The preferred oxygen-containing gas is air, and for convenience the invention will hereinafter be described with air as the oxygen-containing gas; it should be understood, though, that any oxygen-containing gas appropriate for fuel combustion may be employed. The region between the fuel injection point and the most upstream air injection point is referred to as the first zone, and should be of sufficient length to provide for thorough mixing of the fuel and catalyst. The number and location of the air injection points regulates the fuel combustion and define the transfer line's remaining zones.

In the first embodiment, air is conducted to the transfer line at two or more points downstream of the fuel injection point. The air amount and temperature is adjusted in order to reduce fuel requirements, lessen the $O_2$ concentration at the air injection points, and to maintain the air temperature above the fuel's autoignition temperature. More preferably the air's temperature is maintained about 200° F. to about 300° F. above the fuel's autoignition temperature. The air's temperature and O2 concentration may adjusted by direct, in-line combustion of fuel external to the process Accordingly, the air's temperature is preferably adjusted to a temperature ranging from about 1150° F. to about 1400° F. prior to injection into the transfer line.

In the first embodiment, the amount of air injected at the first (most upstream) air injection point regulates the fuel air mixture in the riser's second zone. The length of a zone may be fixed by calculating the final equilibrium temperature that would result from the amount of fuel, CO, and air present at the upstream end of the zone. The length of the zone is selected to provide a zone effluent having an average temperature of about 75% of the calculated equilibrium value. Preferably, the amount of air injected into the second zone provides a sub-stoichiometric amount of oxygen with the fuel. Consequently, CO formation will be promoted in the second zone and $O_2$ depletion will be enhanced in order to slow combustion and reduce peak temperatures. The fuel may be a hydrocarbon such as fuel gas or a liquid fuel. Liquid fuels include heavy oil, residual oils, gas oils, naphtha, and derivatives thereof. In one embodiment, liquid fuel is employed because it generally bums slower than fuel gas, or at lower autoignition temperature compared to the available fuel gas.

Downstream of the second zone, air is injected into the transfer line at one or more points in order to gradually oxidize the CO to $CO_2$ in a third zone when two air injection point are employed after the second zone, and in subsequent zones when still more air injection points are employed. Preferably, air is injected into the transfer line at a velocity of about 100 ft/sec in order to avoid the formation of a stable stoichiometric flame near the air injection point(s). The number of air injection points may be selected to distribute combustion in order to maintain catalyst temperatures in the transfer line well below the catalyst deactiviation temperature. As discussed, the distance between air-injection points when more than one point is employed (i.e. the zone length in the air injection region) is fixed at a length where the catalyst and combustion products approach thermal equilibrium prior to the next downstream air injection point. It may be desirable for the transfer line's effluent to contain CO, $CO_2$, $O_2$, or some combination thereof. The relative amounts of these species in the effluent may be regulated by adjusting the length of the transfer line. Accordingly, extending the transfer line's length would lead to an increased amount of $CO_2$ in the effluent, and decreasing the line's length would result in an increased amount of $O_2$ and CO in the effluent.

As illustrated in FIG. 2, the transfer line downstream of the fuel injection point is preferably swedged to adjust velocities inside the line. Accordingly, the transfer line diameter is adjusted to provide a fluidized velocity of at least about 10 ft/sec, preferably about 15 ft/sec, in the transfer line's first zone increasing to about 25 ft/sec at the line's downstream termination at the regenerator. The variation of transfer line diameter along the length of the transfer line is referred to herein as the transfer line diameter profile. Generally, moderate velocity is favored to promote back-mixing and even distribution of the fuel with the catalyst In a second embodiment, the total amount of air is injected into the transfer line at point (1), and no air is injected in the transfer line's upstream zones. While sub-stoichiometric combustion conditions are not employed in this embodiment, the distribution of combustion in the transfer line may be regulated by the number and distribution of the fuel injection points in order to maintain the transfer line temperature below the catalyst deactivation temperature. Optional fuel ignitors may be located near the fuel injection points. As in the first embodiment, the air may be heated prior to injection, and the transfer line may be swedged. Moreover, when more than one fuel injection point is employed, the distance between points (zone length) may be adjusted so that the catalyst and combustion products approach thermal equilibrium prior to the next downstream fuel injection point. The total length of the transfer line may be fixed by considerations such as the desirability of complete fuel combustion within the transfer line, providing appropriate amounts of CO, $CO_2$, $O_2$ in the effluent, and combinations thereof.

In a third embodiment, air and fuel are injected at point (1) in amounts sufficient to maintain combustion conditions in the first zone. Air, fuel, and mixtures thereof may be injected at downstream injection points to provide for distributed combustion along the transfer line, again to regulate transfer line temperature below the catalyst deactivation temperature. Preferably the amounts of the fuel and the air are selected to provide for combustion of at least a portion of the fuel and oxygen-containing gas under partial oxidation conditions in the first zone in order to form CO. Then, at least a portion of the CO in the second zone and the zone(s) downstream of the second zone is oxidized in order to form $CO_2$. More preferably, the amount of oxygen-containing gas is regulated in zones containing a significant amount of un-combusted fuel to provide sub-stoichiometric combustion conditions, and the amount of oxygen-containing gas in zones containing a significant amount of CO is regulated to provide conditions including sub-stoichiometric, stoichiometric, and super-stoichiometric combustion conditions. Optional fuel ignitors may be located near the fuel injection points.

As in the first embodiment, the air may be heated prior to injection, and the transfer line may be swedged. Moreover, when more than one fuel or air injection point is employed downstream of the first zone, the distance between points may be adjusted so that the catalyst and combustion products approach thermal equilibrium prior to the next downstream fuel or air injection point. The total length of the transfer line may be fixed by considerations such as the desirability of complete fuel combustion, the desired amounts of CO, $CO_2$, $O_2$ in the effluent, and combinations thereof.

Cat cracker feeds used in FCC processes are hydrocarbons such as gas oils, heavy oils, distillate oils, cycle oils, naphthas, and mixtures thereof. Gas oils include high boiling, non-residual oils, such as a vacuum gas oil (VGO), a straight run (atmospheric) gas oil, a light cat cracker oil (LCGO) and coker gas oils. These oils have an initial boiling point typically above about 450° F. (232° C.), and more commonly above about 650° F. (343° C.), with end points up to about 1150° F. (621° C.), as well as straight run or atmospheric gas oils and coker gas oils.

Heavy feeds include hydrocarbon mixtures having an end boiling point above 1050° F. (e.g., up to 1300° F. or more). Such heavy feeds include, for example, whole and reduced crudes, resids or residua from atmospheric and vacuum distillation of crude oil, asphalts and asphaltenes, tar oils and cycle oils from thermal cracking of heavy petroleum oils, tar sand oil, shale oil, coal derived liquids, syncrudes and the like. These may be present in the cracker feed in an amount of from about 2 to 50 volume % of the blend, and more typically from about 5 to 30 volume %. These feeds typically contain too high a content of undesirable components, such as aromatics and compounds containing heteroatoms, particularly sulfur and nitrogen. Consequently, these feeds are often treated or upgraded to reduce the amount of undesirable compounds by processes, such as hydrotreating, solvent extraction, solid absorbents such as molecular sieves and the like, as is known.

Naphtha feeds include olefinic naphthas having hydrocarbon species boiling in the naphtha range. More specifically, the olefinic naphthas contain from about 5 wt. % to about 35 wt. %, preferably from about 10 wt. % to about 30 wt. %, and more preferably from about 10 to 25 wt. % paraffins, and from about 15 wt. %, preferably from about 20 wt. % to about 70 wt. % olefins. The feed may also contain naphthenes and aromatics. Naphtha boiling range streams are typically those having a boiling range from about 65° F. to about 430° F., preferably from about 65° F. to about 300° F., and more preferably from 65° F. to about 150° F. The naphtha may be a thermally cracked or a catalytically cracked naphtha. Such naphthas may be derived from any appropriate source, for example, they can be derived from the fluid catalytic cracking (FCC) of gas oils and resids, from delayed or fluid coking of resids, from pyrolysis of virgin naphthas or gas oils, and mixtures thereof. Preferably, the naphtha streams are derived from the fluid catalytic cracking of gas oils and resids. Such naphthas are typically rich in olefins, diolefins, and mixtures thereof, and relatively lean in paraffins.

In one embodiment using a gas oil feed, heavy feed, and mixtures thereof, FCC process conditions include a temperature of from about 800 –1200° F., preferably 850–1150° F. and still more preferably 900–1075° F., a pressure between about 5–60 psig, preferably 5–40 psig with feed/catalyst contact times between about 0.5–15 seconds, preferably about 1–5 seconds, and with a catalyst to feed ratio of about 0.5–10 and preferably 2–8. The FCC feed is preheated to a temperature of not more than 850° F., preferably no greater than 800° F. and typically within the range of from about 500–800° F.

In another embodiment using a naphtha feed, FCC conditions include temperatures from about 900° F. to about 1200° F., preferably from about 1025° F. to 1125° F., hydrocarbon partial pressures from about 10 to 40 psia, preferably from about 20 to 35 psia; and a catalyst to naphtha (wt/wt) ratio from about 3 to 12, preferably from about 4 to 10, where catalyst weight is total weight of the catalyst composite. Though not required, it is also preferred that steam be concurrently introduced with the naphtha stream into the reaction zone, with the steam comprising up to about 50 wt. % of the hydrocarbon feed. Also, it is preferred that the naphtha residence time in the reaction zone be less than about 10 seconds, for example from about 1 to about 10 seconds.

The invention will be further understood with reference to the following example.

EXAMPLE 1

An integrated process simulation was conducted to demonstrate the effectiveness of the transfer line illustrated in FIG. 2. In the simulation, fuel is injected at the base of the transfer line. The transfer line's first (lower) region was set at 30 inches diameter, with a length of 10 ft. The transfer line diameter was increased to 60 inches in a second region for a length of 18 feet, then to a diameter of 72 inches for another 12 feet in a third region, and finally to a diameter of 84 inches in a fourth region for a length of 50 feet to the transfer line's termination at the regenerator.

10 wt. % of the total air supplied to the line was heated to a temperature of 1200° F. and injected into the transfer line via a 10 in. diameter line located at the downstream end of the first region An additional 15 wt. % of the air was heated to 1200° F. and injected further downstream in the second region via a 12 inch diameter line. 30 wt. % of the air was then heated to 1200° F. and injected via a 16 inch diameter line terminating in a ring header at the downstream end of the third region. The final 45 wt. % of the air was heated to 1200° F. and injected at the downstream end of the fourth region via a 16 inch diameter line terminating in a ring header. The total amount of air was 36.7 kscfm and the total amount of fuel was 0.75 kscfm of methane used for air preheat and 1.10 kscfm propane to the air riser. The catalyst/vapor mixture is accelerated to about 10 ft/sec in the bottom section and further accelerated to about 25 ft/sec along the length of the riser. About 23 s-tons/min catalyst circulating is heated from about 1075° F. to about 1265° F. At the desired reaction process conditions, adequate heat is produced to heat balance the unit.

Figure 3:
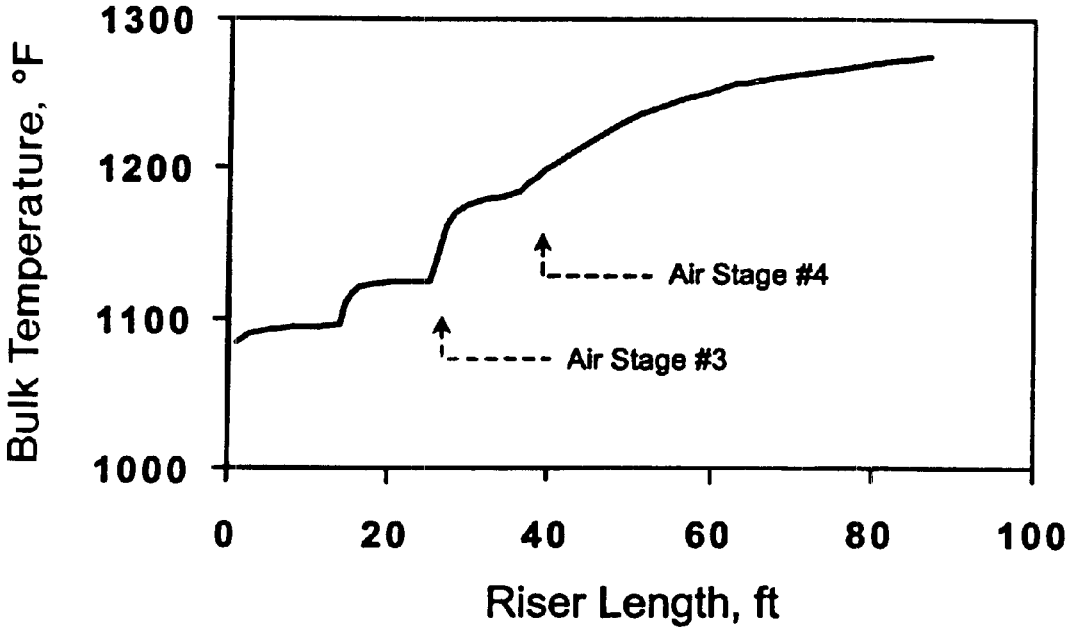
FIG. 3 is a model of the temperature profile along the transfer line, in accordance with example 1.

A calculation of the bulk temperature profile along the transfer line is shown in FIG. 3. As can be seen in the figure, thermal equilibrium is achieved at the end of each stage.

EXAMPLE 2

Figure 4:
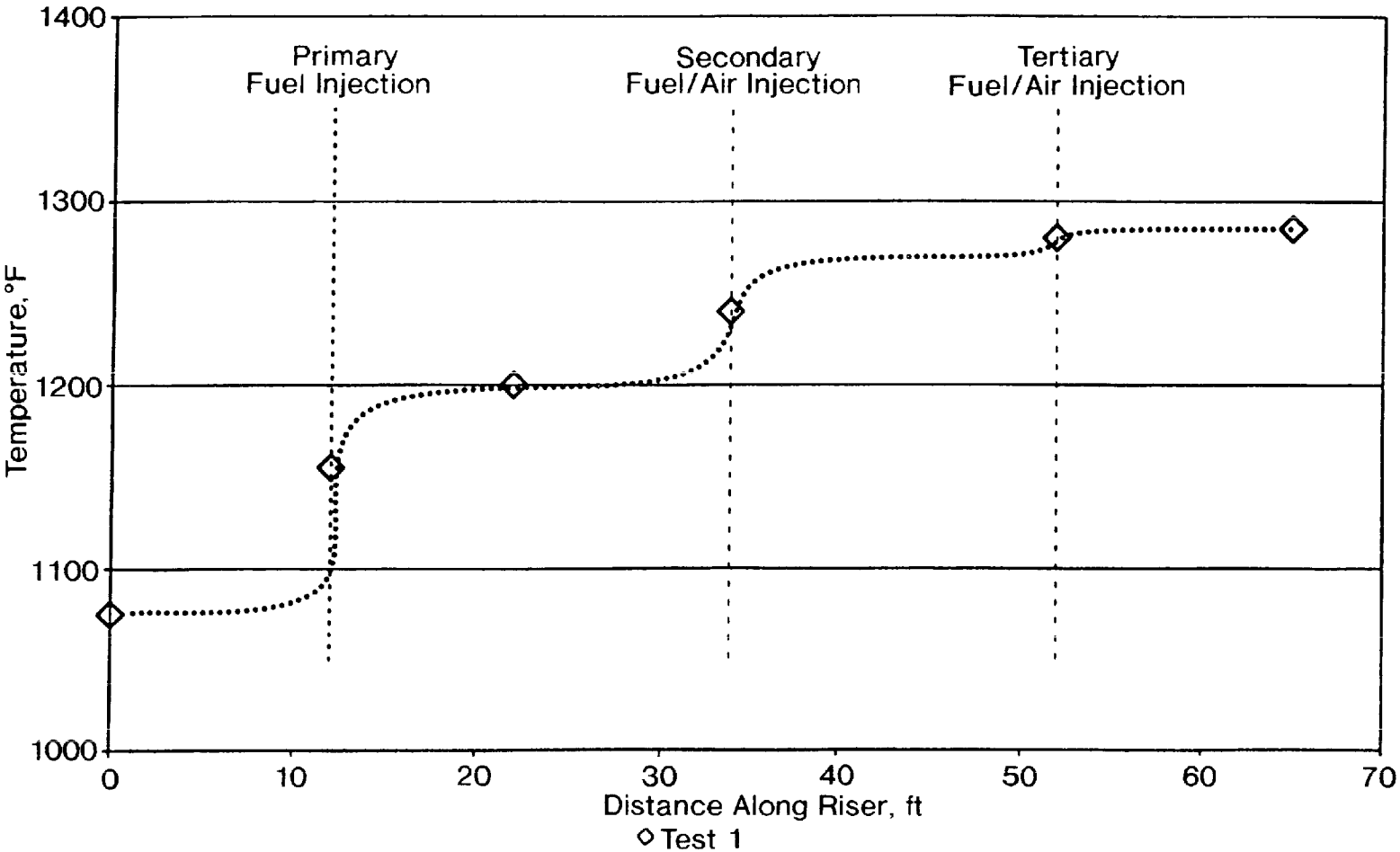
FIG. 4 illustrates a measured temperature profile along the transfer line, in accordance with example 2.

A large-scale air riser demonstration test was conducted to demonstrate the effectiveness of the embodiment illustrated in FIG. 2. The test was conducted in a 40" ID by 60' high riser combustor to confirm continuous distributed burning of a fuel stream in the transfer line could be achieved at the desired process performance. In this test, the majority of the air was injected at the base of the riser. During the test, about 1065 scfm of preheated air was added to the base of the riser where it mixed with about one ton/hr of circulating catalyst, providing the initial lift. At about an elevation of 15', about 30 scfm of propane was added to the system. Additional air (about 530 scfm) and propane (about 25 scfm) were added at an elevation of 35'. Further, additional air (about 180 scfm) and propane (about 15 scfm) were added at an elevation of 48'. The velocity in the lower section up to about an elevation of 15' was about 7 ft/sec, increasing to about 12 ft/sec up to an elevation of about 35' and further to about 15 ft/sec above an elevation of about 48'. The temperature in the riser ranged form about 1100° F. in the bottom of the riser to about 1300° F. near the top of the riser during steady operations. The measured the bulk temperature profile along the transfer line is shown in FIG. 4.

What is claimed is:

1. A fluidized bed catalytic cracking process comprising the continuous steps of:

(a) conducting a hydrocarbon-containing feedstream to a reaction zone where the feed contacts a source of hot, regenerated catalyst in order to form at least cracked products and spent catalyst;

(b) conducting the cracked products and the spent catalyst to a separation zone and separating the spent catalyst;

(c) conducting the spent catalyst to an upstream end of a transfer line;

(d) conducting a fuel and an oxygen-containing gas independently to one or more points along the transfer line and combusting the fuel and the oxygen in the transfer line in order to form an effluent containing the hot, regenerated catalyst;

(e) separating the hot, regenerated catalyst from the transfer line's effluent and then;

(f) conducting the hot, regenerated catalyst to step (a).

2. The process of claim 1 wherein the spent catalyst has a temperature ranging from about 900 to about 1175° F.

3. The process of claim 2 wherein the spent catalyst has a temperature ranging from about 900 to about 1150° F.

4. The process of claim 3 wherein the spent catalyst has a temperature ranging from about 900 to about 1100° F.

5. The process of claim 1 wherein the hot, regenerated catalyst has a temperature ranging from about 1200° F. to about 1400° F.

6. The process of claim 5 wherein the hot, regenerated catalyst has a temperature ranging from about 1200° F. to about 1300° F.

7. The process of clam 6 wherein the hot, regenerated catalyst has a temperature ranging from about 1250° F. to about 1285° F.

8. The process of claim 1 further comprising conducting the spent catalyst of step (b) to a stripping zone, contacting the spent catalyst with steam to remove hydrocarbon from the spent catalyst in order to form stripped, spent catalyst, and then conducting the stripped, spent catalyst to the transfer line of step (c).

9. The process of claim 1 wherein the transfer line is a zoned transfer line having at least a first zone, a third zone downstream of the first zone, and a second zone situated therebetween, and wherein the fuel is conducted to the first zone, and the oxygen-containing gas is conducted to at least the second and third zones.

10. The process of claim 9 wherein the amount of oxygen-containing gas is regulated in zones containing a significant amount of un-combusted fuel to provide sub-stoichiometric combustion conditions.

11. The process of claim 10 wherein the spent catalyst and the fuel are mixed in the first zone.

12. The process of claim 11 wherein at least a portion of the oxygen containing gas and the fuel are combusted under sub-stoichiometric conditions in the zones downstream of the first zone in order to form CO, and at least a portion of the CO in the zones downstream of the second zone is oxidized in order to form $CO_2$.

13. The process of claim 12 wherein the oxygen-containing gas is air, wherein the air's temperature at injection into the transfer line is maintained about 200° F. to about 300° F. above the fuel's autoignition temperature, and wherein the air is injected into the transfer line at a velocity of about 100 ft/sec.

14. The process of claim 13 wherein the air's temperature ranges from about 1150° F. to about 1400° F., prior to injection into the transfer line.

15. The process of claim 12 wherein the first zone's effluent contains uncombusted fuel, and wherein the amount of air injected into the second zone provides a sub-stoichiometric amount of oxygen with the un-combusted fuel in order to form CO in the second zone's effluent.

16. The process of claim 15 wherein at least a portion of the CO in the second zone's effluent is oxidized to $CO_2$ in the third zone.

17. The process of claim 9 wherein the transfer line has a diameter and a diameter profile sufficient to provide a fluidized velocity of at least about 10 ft/see but less than about 21 ft/sec in the transfer line's first zone, increasing to about 25 ft/sec at the liners downstream end.

18. The process of claim 1 wherein the transfer line is a zoned transfer line having at least a first zone, a third zone downstream of the first zone, and a second zone situated therebetween, and wherein the oxygen-containing gas is conducted to the first zone, and the fuel is conducted to the zones downstream of the first zone.

19. The process of claim 18 wherein the fuel is conducted to the second zone.

20. The process of claim 19 wherein the fuel is conducted to the second zone and the third zone.

21. The process of claim 19 wherein the oxygen-containing gas is air, wherein the air's temperature at injection into the transfer line is maintained about 200° F. to about 300° F. above the fuel's autoignition temperature, and wherein the air is injected into the transfer line at a velocity of about 100 ft/sec.

22. The process of claim 21 wherein the air's temperature ranges from about 1150° F. to about 1400° F., prior to injection into the transfer line.

23. The process of claim 19 wherein the transfer line has a diameter and a diameter profile sufficient to provide a fluidized velocity of at least about 10 ft/sec but less than about 21 ft/sec in the transfer line's first zone, increasing to about 25 ft/sec at the line's downstream end.

24. The process of claim 1 wherein the transfer line is a zoned transfer line having at least a first zone, a third zone downstream of the first zone, and a second zone situated therebetween, and wherein at least a portion of the oxygen-containing gas and the fuel are combusted in the first zone to form CO, and at least a portion of the CO in the second zone and the zones downstream of the second zone is oxidized in order to form $CO_2$.

25. The process of claim 24 wherein the oxygen-containing gas is air, wherein the air's temperature at injection into the transfer line is maintained about 200° F. to about 300° F. above the fuel's autoignition temperature, and wherein the air is injected into the transfer line at a velocity of about 100 ft/sec.

26. The process of claim 25 wherein the air's temperature ranges from about 1150° F. to about 1400° F., prior to injection into the transfer line.

27. The process of claim 24 wherein the transfer line has a diameter and a diameter profile sufficient to provide a fluidized velocity of at least about 10 ft/sec sec but less than about 21 ft/sec in the transfer line's first zone, increasing to about 25 ft/sec at the line's downstream end.

* * * * *